US005673514A

United States Patent [19]

McKeon

[11] Patent Number: 5,673,514

[45] Date of Patent: Oct. 7, 1997

[54] TIME DELAY RELEASE MECHANISM FOR A FIRE BARRIER

[75] Inventor: James M. McKeon, Brooklyn, N.Y.

[73] Assignee: McKeon Rolling Steel Door Company, Inc., Brooklyn, N.Y.

[21] Appl. No.: 536,520

[22] Filed: Sep. 29, 1995

[51] Int. Cl.[6] ..... E05F 15/20

[52] U.S. Cl. ..... 49/30

[58] Field of Search ..... 49/29, 30; 74/3.5

[56] References Cited

U.S. PATENT DOCUMENTS

| | | | |
|---|---|---|---|
| 4,130,156 | 12/1978 | Wardlaw | 160/9 |
| 4,426,639 | 1/1984 | Jessup | 49/30 X |
| 4,428,278 | 1/1984 | Sutton | 49/30 X |
| 4,738,052 | 4/1988 | Yoshida | 49/31 |
| 4,785,293 | 11/1988 | Shearer et al. | 340/628 |
| 5,245,879 | 9/1993 | MKeon | 74/2 |
| 5,261,186 | 11/1993 | Saino | 49/8 |

*Primary Examiner*—Kenneth J. Dorner
*Assistant Examiner*—Jerry Redman
*Attorney, Agent, or Firm*—Cohen, Pontani, Lieberman & Pavane

[57] ABSTRACT

A time delay release mechanism has a brake actuator including an actuation member movable between engaged and released positions. The actuation member, when in the engaged position, operatively engages a fire barrier for preventing closure thereof. The actuation member, when in the released position, is operatively disengaged from the fire barrier such that the release mechanism does not prevent closure thereof. The brake actuator includes an actuation driver which, when receiving electrical power, moves the actuation member to the released position. A timer, when receiving electrical power or when power thereto is interrupted for a duration less than a predetermined time period, disengages from the actuation member allowing the actuation driver, when power thereto is initially interrupted, to move the actuation member to the engaged position. The timer engages the actuation member, when power to the timer is interrupted for a duration greater than the predetermined time period, to move the actuation member to the released position thereby overriding the actuation driver to allow closure of the fire barrier. The timer disengages from the actuation member when power to the timer is restored and the actuation driver retains the actuation member in the released position when power to the actuation driver is restored, thereby automatically resetting the brake actuator and timer.

9 Claims, 8 Drawing Sheets

TIME DELAY RELEASE MECHANISM FOR A FIRE BARRIER

FIELD OF THE INVENTION

The present invention relates to a time delay release mechanism and, more particularly, to a time delay release mechanism for a fire barrier which is automatically resettable after being activated by a power failure.

BACKGROUND OF THE INVENTION

Fire barriers, such as fire doors for buildings and the like, may include a brake which allows closure of the barrier in response to certain emergencies, such as a fire. Such a brake may be electrically connected to the electrical power supply of the building such that when the supply of electricity to the building is interrupted, as often happens during a fire, the brake releases the fire barrier.

A problem with such a brake is that any power interruption, however brief and for whatever reason, causes the brake to release the fire barrier, frequently resulting in closure thereof. It is well known that not all power failures are the result of an emergency. For example, in the absence of a fire, a power failure may be produced by a false alarm of a smoke detector or the like, by maintenance or repair of the electrical wiring in the building, by an electrical disturbance in the transmission lines leading to the building, or by an electrical storm. In the absence of a fire, a power outage need not and preferably does not produce closure of the fire barrier. Shortly after a fire barrier closes due to a power failure, it is usually necessary to reset the fire barrier to the position thereof just before the power outage. Opening and positioning a fire barrier is typically time-consuming and may also be arduous.

It is known to add a timer mechanism to the brake which, when the supply of electricity to the building is interrupted, prevents the brake from closing the fire barrier for a duration no longer than a predetermined time period, which is typically 30 seconds or less. If the power interruption exceeds the predetermined time period, in which event the power outage is assumed to be the result of a fire or other emergency warranting closure, the brake releases the fire barrier for effecting closure thereof.

If the power supply to the building is restored within the predetermined time period, then the timer mechanism is reset thereby avoiding unnecessary closure of the fire barrier. Resetting the timer mechanism entails returning the timer mechanism to the state from which the timer mechanism may automatically respond to a power interruption in the aforesaid advantageous manner. A known timer mechanism may, at the end of a power interruption which is less than the predetermined time period, automatically reset itself. The timer mechanism is then ready to respond to subsequent power failures.

It is not known, however, for such a timer mechanism to automatically reset itself after a power failure of sufficient duration to release the brake thereby allowing closure of the fire barrier. Rather, after a power outage during which the fire barrier closes, the timer mechanism known from the prior art must be manually reset so that the timer mechanism may respond to a subsequent power outage in the aforesaid advantageous manner.

Manually resetting the timer mechanism is usually time-consuming and may be arduous, and a skilled worker may be required to perform the procedure. For example, manual resetting may entail drawing a link member secured to one end of a cable, chain or the like, which is coupled to the fire barrier, to a grasping device, such as a latch, clasp or the like, of the timer mechanism and fastening the link member to the grasping device which prevents automatic closure of the fire barrier. The cable, chain or the like is normally mechanically biased to resist such positioning so that release of the link member will automatically remove the obstruction to closure of the fire barrier established when the cable, chain or the like is secured to the grasping device.

The latch may also be mechanically biased to open thereby releasing the link member to allow the fire barrier to close. Such a latch is typically supported in the closed position by one or more structural members which balance the mechanical biasing except when an emergency condition arises warranting closure of the fire barrier, at which time the structural members automatically fall away or otherwise allow the mechanical biasing to automatically force open the latch.

Manually situating such structural members to become unstable under certain predetermined conditions normally requires positioning other parts and, as a result, is complex. Moreover, overcoming the mechanical biasing which resists movement of the link member to the latch may be arduous if done manually.

SUMMARY OF THE INVENTION

According to one aspect of the present invention, a time delay release mechanism has a brake actuation means including an actuation member movable between an engaged position and a released position. The actuation member, when in the engaged position, operatively engages a fire barrier for preventing closure thereof. The actuation member, when in the released position, is operatively disengaged from the fire barrier such that the time delay release mechanism does not prevent closure thereof. The brake actuation means includes an actuation driver means which, when receiving electrical power, moves the actuation member to the released position.

The time delay release mechanism further includes a timer means which, when receiving electrical power or when power thereto is interrupted for a duration less than a predetermined time period, disengages from the actuation member allowing the actuation driver means, when power thereto is initially interrupted, to move the actuation member to the engaged position. The timer means engages the actuation member, when power to the timer means is interrupted for a duration greater than the predetermined time period, to move the actuation member to the released position thereby overriding the actuation driver means to allow closure of the fire barrier. The timer means disengages from the actuation member when power to the timer means is restored and the actuation driver means retains the actuation member in the released position when power to the actuation driver means is restored thereby automatically resetting the brake actuation means and timer means.

The timer means may comprise a capacitive means which is charged via electrical connection thereof to the electrical source. When electricity to the capacitive means is interrupted resulting in discharge thereof, the time duration required for full discharge defines the predetermined time period. The capacitive means is recharged and thereby automatically reset when the supply of electricity thereto is restored.

The various features of novelty which characterize the invention are pointed out with particularity in the claims annexed to and forming a part of this disclosure. For a better understanding of the invention, its operating advantages, and specific objects attained by its use, reference should be made to the following detailed description in conjunction with the accompanying drawings in which there are illustrated and described currently preferred embodiments of the invention. It is to be understood, however, that the detailed description and drawings are intended to illustrate and not to define the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 1:
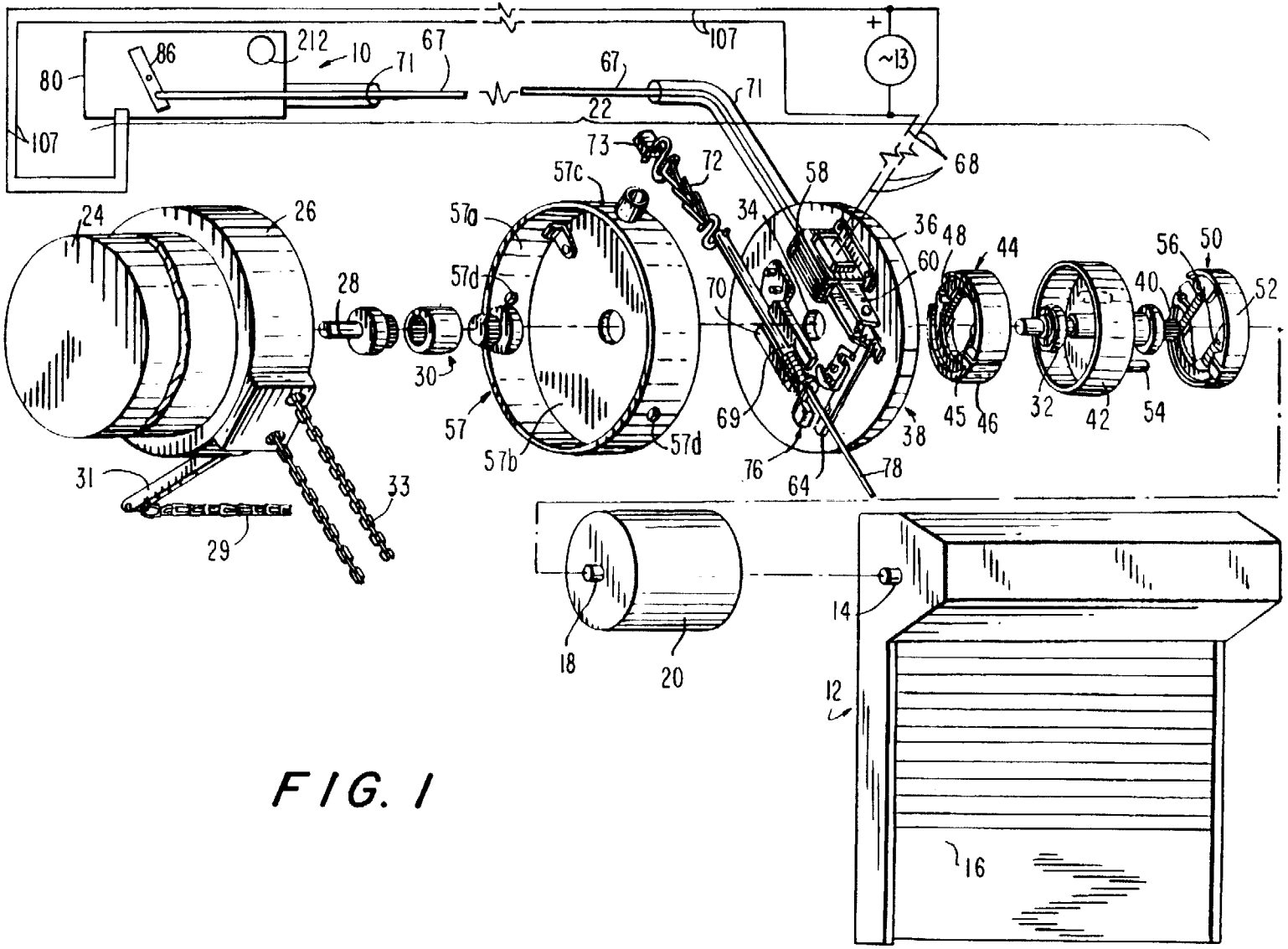
FIG. 1 is an exploded view of a portion of the control mechanism of the present invention for selectively opening and closing a roll-type fire door wherein the brake controller of the control mechanism is connected, via a brake cable, to the time delay release mechanism, shown in schematic.

Referring now to the drawings, FIG. 1 illustrates a fire barrier and, more particularly, a fire barrier defined by a motor controlled fire door assembly designated generally by the reference number 12 in operative engagement with a time delay release mechanism identified by the general reference number 10 and constructed in accordance with the teachings of the present invention. An electrical source 13, typically a conventional 110 volt AC source, supplies power to components of release mechanism 10 and motor controlled fire door assembly 12 as described further hereinbelow.

The motor controlled fire door assembly 12 shown in FIG. 1 is disclosed in U.S. Pat. No. 5,245,879, the entire disclosure of which is expressly incorporated by reference herein. Although the embodiment of release mechanism 10 shown in FIG. 1 is illustrated for use with motor-controlled fire door assembly 12, it will be appreciated that the release mechanism 10 may also be used with other motor controlled fire barriers including, but not limited to, shutters, dampers and roof hatches.

Figure 2A:
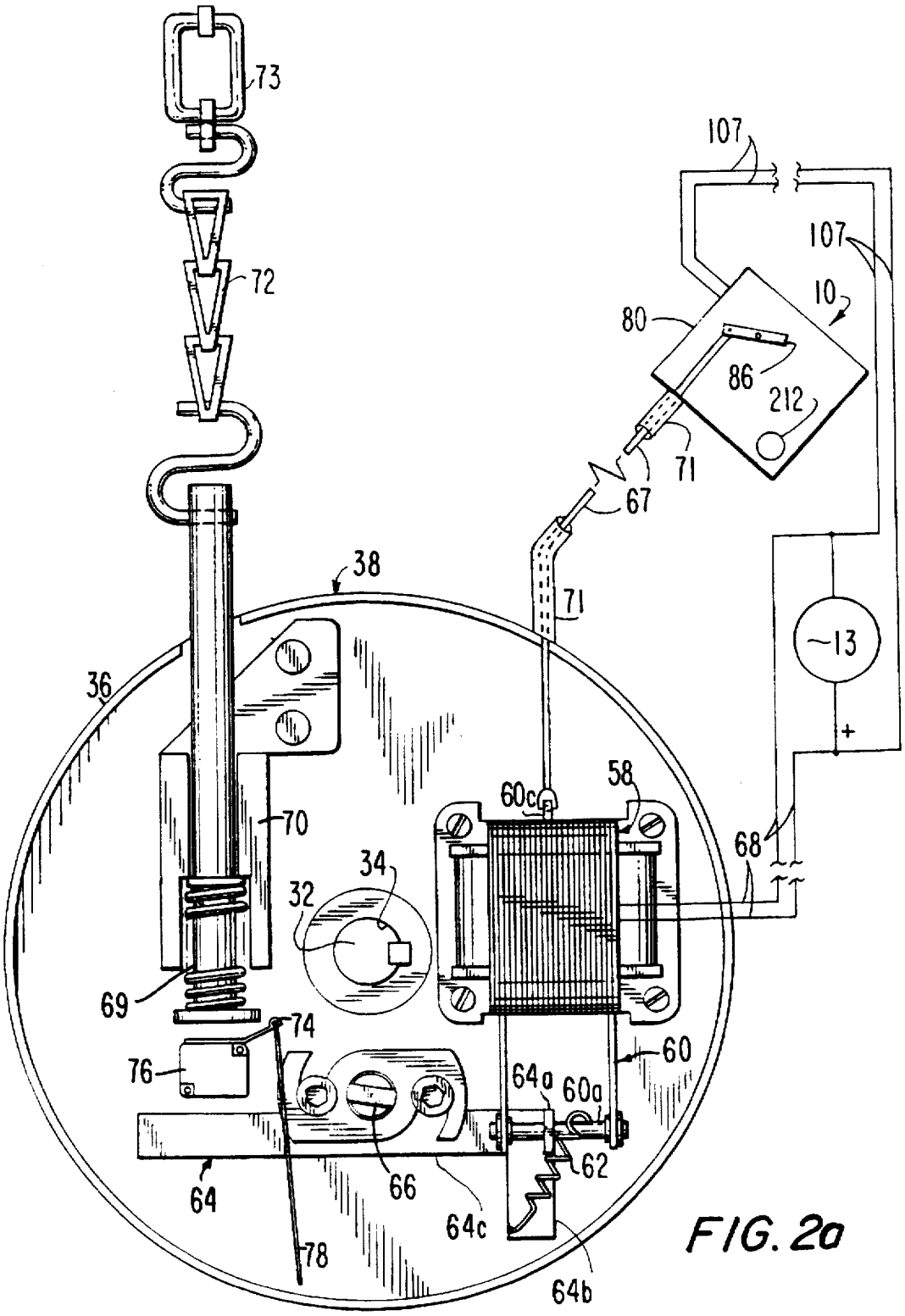
FIGS. 2*a* and 2*b* are enlarged side elevational views of the brake controller and a schematic view of the time delay release mechanism of FIG. 1 showing the relative positions of parts thereof with the brake controller and the brake released (FIG. 2*a*) and just after a power failure when the release mechanism positions the brake controller to move the brake into engagement with the fire door (FIG. 2*b*)
Figure 2B:
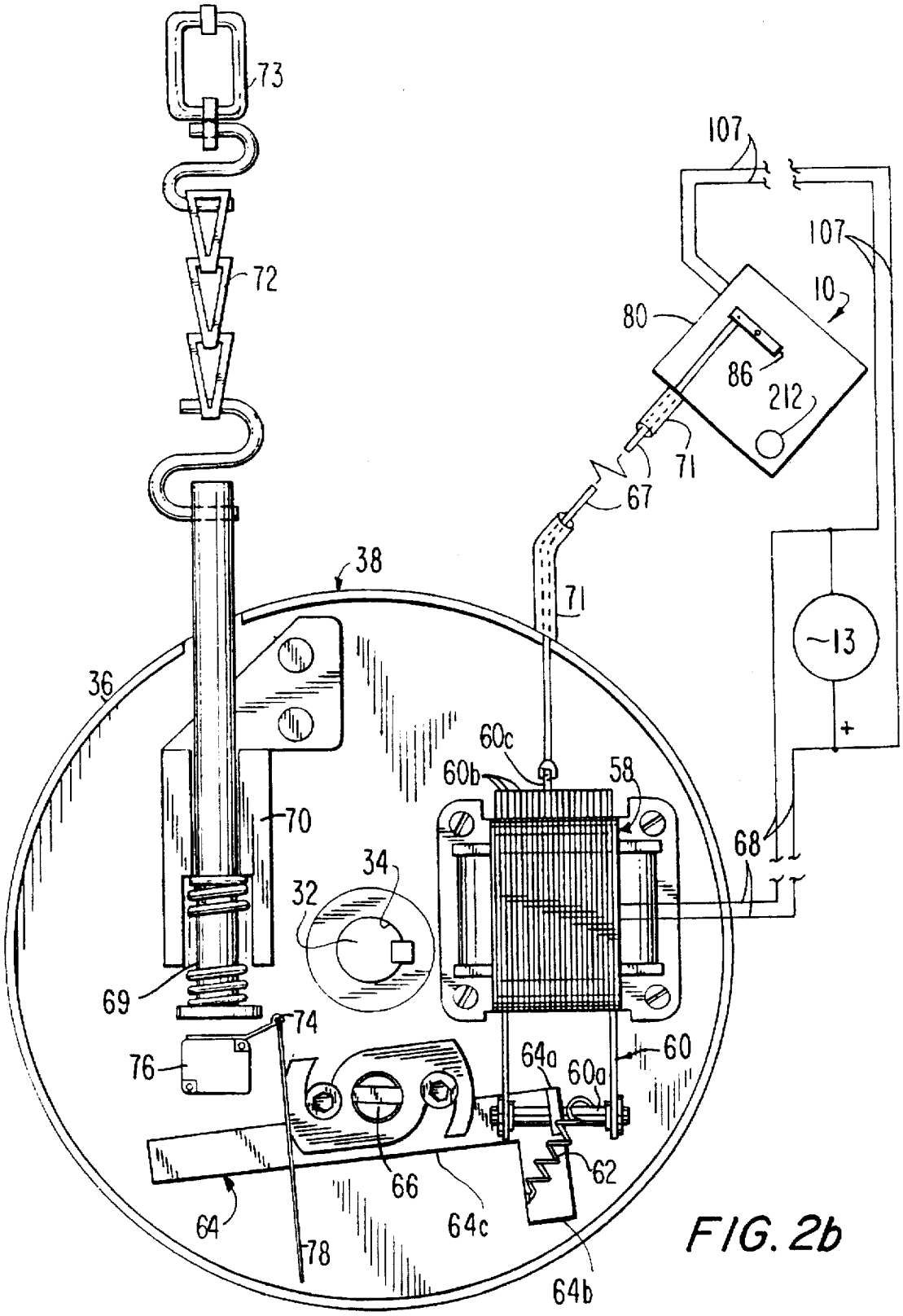

Still referring to FIG. 1, motor controlled fire door assembly 12 includes a low speed output shaft 14 around which a roll-type fire door 16 is wound. The fire door 16 is raised and lowered by rotation of output shaft 14 which is rotatably coupled, via a conventional speed reduction means 20, to a high speed input shaft 18. Rotation of input shaft 18 is controlled by a motor-operator unit generally designated by reference numeral 22 in FIG. 1. The motor-operator unit 22, described hereinbelow and illustrated in FIGS. 1, 2*a* and 2*b*, is disclosed in U.S. Pat. No. 5,245,879 referenced hereinabove.

The motor-operator unit 22 includes a motor 24 secured to a conventional hand chain assembly 26. The motor 24 has a drive shaft (not shown) passing through hand chain assembly 26 for driving a shaft 28. The shaft 28 may alternatively be rotated by hand chain assembly 26, when, for example, motor 24 is unavailable due to a power interruption, or inspection or servicing thereof. The hand chain assembly 26 includes a cable 29 which, when pulled, engages a lever 31 such that pulling a hand chain 33 produces concomitant rotation of shaft 28.

The shaft 28 engages a coupling designated generally by the reference number 30 which, in turn, drives an input shaft 32 passing through a housing 57 and hole 34 in support plate 36 of a brake controller designated generally by the reference number 38. The other end of input shaft 32 is connected to a splined shaft 40 which operatively engages the high speed input shaft 18.

The motor-operator unit 22 further includes a cast iron drum 42 attached to input shaft 32 so as to rotate therewith and a brake designated generally by the reference number 44, which does not rotate with shaft 32, within the drum. The brake 44 includes two pivotally connected brake shoes 46 for selectively engaging drum 42 for blocking rotation of input shaft 32. The brake 44 includes a pair of tension springs 48 biasing brake shoes 46 out of engagement with drum 42.

The motor-operator unit 22 also includes a speed governor designated generally by the reference number 50 connected by a pin 54 to drum 42 for rotation therewith. Governor 50 includes a pair of pivotally connected brake shoes 52 and a pair of tension springs 56 which bias brake shoes 52 out of engagement with a stationary housing (not shown) until input shaft 32 rotates above a predetermined speed whereupon centrifugal forces separate brake shoes 52 for applying a braking friction against the inside of the stationary housing to slow the rotational speed of input shaft 32. For example, automatic closure of the fire door 16 may result in input shaft 32 reaching a high rotational speed thereby actuating governor 50 for preventing door 16 from slamming shut at an undesirably high speed.

As illustrated in FIGS. 1, 2*a* and 2*b*, the brake controller 38 includes a brake solenoid 58 mounted on a support plate 36 and having a core designated generally by the reference number 60 including a cross-pin **60*a*. The cross-pin 60*a* extends through an opening in a flanged portion 64*a* of lever designated generally by the reference number 64. Preferably, though not necessarily, a take-up spring 62 is hooked at one end to cross-pin 60*a* and at the other end to a shoulder portion 64*b* of the lever 64 such that the cross-pin and lever 64 are coupled together through the take-up spring. The intermediate portion 64*c* of lever 64 is fixed to a rotatable brake control shaft 66** for concomitant rotation therewith.

The core 60 includes a plurality of laminates **60*b*, and one laminate 60*c*** which extends beyond the ends of the other laminates as shown in FIGS. 2*a* and 2*b*. Secured to laminate extension **60*c* is a brake cable 67 which, in turn, is connected to release mechanism 10**, as described hereinbelow.

As shown in FIG. 1, the motor-operator unit 22 includes a sheet metal cylindrical covering or housing, designated generally by the reference number 57, having a pair of corresponding inner chambers, one of which 57*a* is shown in FIG. 1, on either side of a circular plate 57*b* fixed to the interior of the housing about midway therein. The support plate 36 and the components of brake controller 38 mounted thereon are received in the other inner chamber, which is hidden in FIG. 1, of housing 57. It will be appreciated that when motor-operated unit 22 is assembled, the housing 57 is axially aligned with and attached to hand chain assembly 26.

Mounted on the side wall of housing 57 is a boss 57*c* having a longitudinal passage therethrough extending to the inner chamber, hidden in FIG. 1, of housing 57, and conductors 68 leading to brake solenoid 58 extend through said boss 57*c* when brake controller 38 is assembled. The side wall of housing 57 also includes a plurality of holes 57*d*, not all of which are shown, through which brake cable 67, plunger 69 and hand cable 78 extend when brake controller 38 is disposed within housing 57.

The brake cable 67 extends between laminate extension 60*c* and release mechanism 10 through a sleeve 71 shown schematically in FIGS. 1, 2*a* and 2*b* such that the ends of the sleeve abut housing 57 and the housing (not shown) for release mechanism 10. Both brake cable 67 and sleeve 71 are preferably steel or other metal, although other materials may be used as is well-known in the art as long as such materials are transversely-flexible.

The brake solenoid 58 is electrically connected, via conductors 68, to electrical source 13. When electrical source 13 supplies power to brake solenoid 58, core 60 is retracted thereby producing, through take-up spring 62 and lever 64, counterclockwise rotation of brake control shaft 66, as shown in FIG. 2*b*. The brake control shaft 66 extends through a hole (not shown) in support plate 36 into an elongate cavity 45 in brake 44. The brake control shaft 66 interlocks with the walls of cavity 45 in a key-type engagement such that counterclockwise rotation of the brake control shaft, as shown in FIG. 2*b*, causes brake shoes 46 to pivot outwardly into engagement with drum 42, i.e. engages brake 44, for blocking rotation of shaft 32 thereby preventing door 16 from closing. In a manner known in the art, the take-up spring 62 enables a single setting of lever 64 relative to brake control shaft 66 to suffice for a range of brake shoe wear conditions. The take-up spring 62 thereby reduces the frequency of required brake adjustments, as compared to an arrangement wherein cross-pin 60*a* is directly connected to lever 64, i.e. without using take-up spring 62.

The brake 44 includes one or more tension springs 48 connected between brake shoes 46 for biasing brake shoes 46 out of engagement with drum 42. Consequently, whenever the centrifugal force exerted on brake shoes causing engagement thereof with drum 42 is removed, the springs 48 pivot brake shoes 46 inwardly to a position in which the brake shoes are disengaged from the drum. The positions of brake control shaft 66 and lever 64 follow the position of brake shoes 46 in accordance with the coupling therebetween, as described hereinabove.

In accordance with the known mechanism, if brake solenoid 58 becomes disabled, such as by interruption of power thereto, such that it is unable to rotate lever 64 counterclockwise to the position shown in FIG. 2*b* to engage brake 44, and brake shoes 46 are not otherwise forced to pivot outwardly, the brake shoes 46 are pivoted inwardly by springs 48 sufficiently to disengage them from drum 42. Consequently, brake 44 is released allowing door 16 to close and causing lever 64 to rotate clockwise in response to clockwise rotation of shaft 66 thereby pulling core 60 against take-up spring 62 to the position shown in FIG. 2*a*. Restoration of power to brake solenoid 58 returns control of brake 44 thereto since the energized brake solenoid may then exert a counterclockwise torque on brake control shaft 66 tending to pivot brake shoes 46 outwardly with a force exceeding the spring force exerted by springs 48 tending to pivot the brake shoes inwardly such that core 60 may pulled to the position shown in FIG. 2*b* wherein brake 44 is engaged for blocking closure of door 16.

The brake controller 38 also includes a spring-loaded plunger 69 slidably mounted in a frame 70 attached to support plate 36. The plunger 69 is held in a retracted position by a chain 72 located externally to motor-operator unit 22. The chain 72 includes a fusible link 73 with a melting temperature of about 135 degrees Fahrenheit. If fusible link 73 melts, the plunger 69 will be driven by the spring-loading thereof into engagement with an emergency actuator 74 for depressing the latter. Depression of emergency actuator 74 opens an emergency switch 76 which interrupts power to brake solenoid 58 thereby releasing the brake 44 and allowing door 16 to close. The emergency switch 76 may also be opened by pulling a hand cable 78 connected thereto.

Figure 3A:
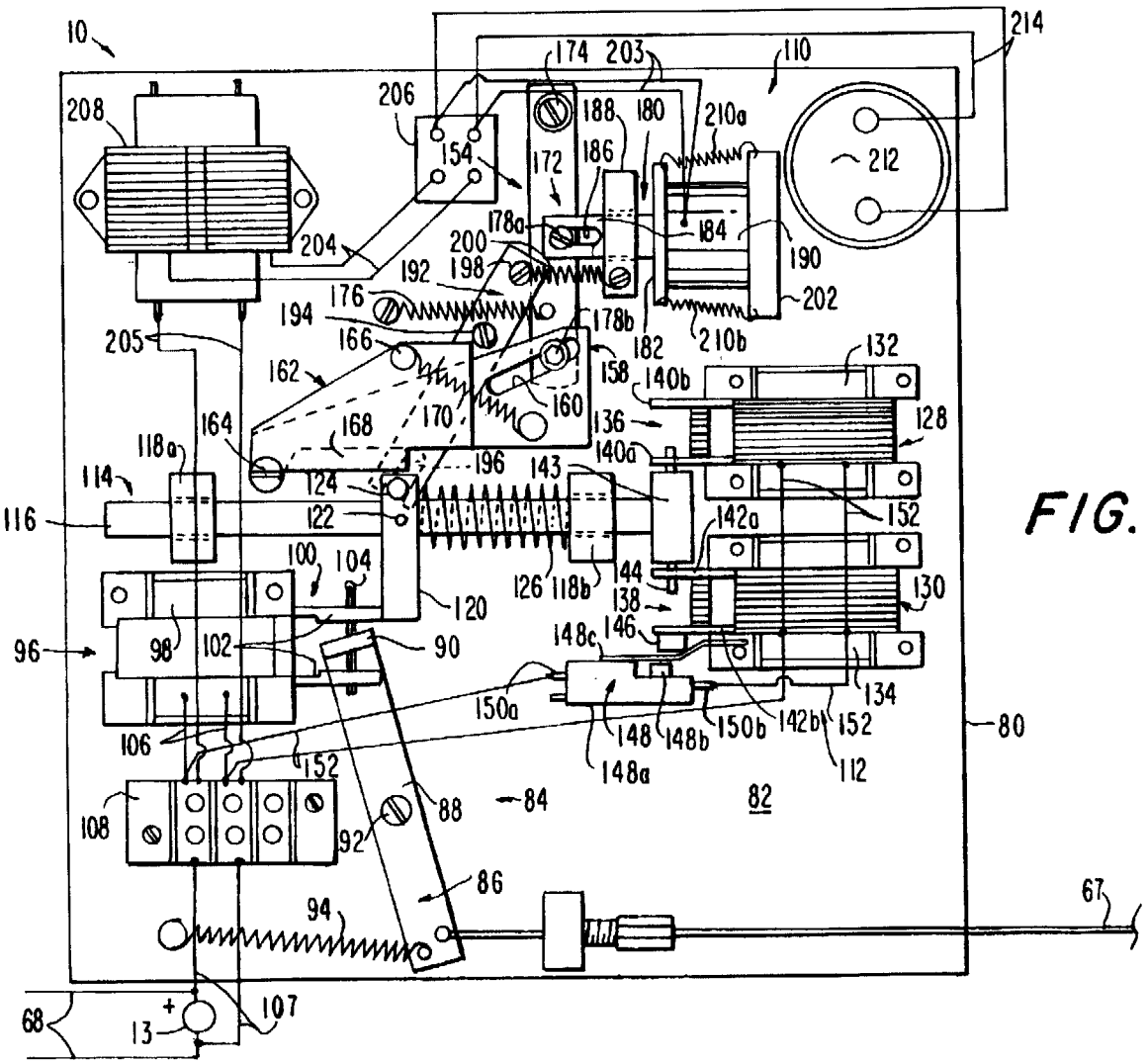
FIGS. 3*a*, 3*b*, 3*c* and 3*d* are enlarged side elevational views of the time delay release mechanism of FIGS. 1, 2*a* and 2*b* showing the relative positions of parts thereof after a power failure of sufficient duration such that the release mechanism releases the brake controller (FIG. 3*a*), after being reset from restoration of power (FIG. 3*b*), after a power failure when release of the brake is prevented by release mechanism (FIG. 3*c*), and just after rotation of the latch cam away from the override member which results in the release mechanism releasing the brake controller (FIG. 3*d*)

Referring now to FIGS. 1 and 3*a*, the time delay release mechanism 10 includes a base 80 having a generally flat mounting surface 82 to which components of the release mechanism, described hereinbelow, are attached. The platform 80 is preferably, though not necessarily, mounted on the structure supporting the motor controlled fire door assembly 12. Alternatively, platform 80 may be mounted on other surfaces which are stationary relative to motor controlled fire door assembly 12, and more particularly brake controller 38, and have sufficient structural integrity to support release mechanism 10 during operation thereof. As will be more fully appreciated as this description progresses, release mechanism 10 is preferably close to brake controller 38 to limit the required length of brake cable 67.

Brake Actuation Means

Attached to mounting surface 82 is a brake actuation means designated generally by the reference number 84 defined by an L-shaped actuation member identified by the general reference number 86 having a main part 88 and a generally perpendicular flange 90 at one end thereof extending away from the surface 82. The main part 88 is attached via a pivot 92 to mounting surface 82 for rotation in a plane parallel thereto.

The brake cable 67 is looped through a hole in the end of main part 88 opposite flange 90. Also hooked to this end of main part 88 is an actuation driver means defined by an actuator spring 94, as shown in FIG. 3*a*. The actuator spring 94 is secured to mounting surface 82 for biasing actuation member 86 against counterclockwise rotation as viewed in FIG. 3*a*.

The actuation driver means further includes an actuator solenoid identified by the general reference number 96 having a body 98 attached to mounting surface 82 and an elongate core identified by the general reference number 100. The end of core 100 extending out of body 98 is forked for defining two arms 102 positioned such that flange 90 extends therebetween. The actuation member 86 is linked to core 100 by a pin 104 extending through arms 102 and flange 90 whereby axial displacement of the core 100 rotates the actuation member about pivot 92.

The actuator solenoid 96 is electrically connected, via conductors 106, 107 and connector plate 108, to the electrical source 13. The actuator solenoid 96 operates on 110 volt AC making transformers and the like between actuator solenoid 96 and electrical source 13 unnecessary. Solenoid 96 is normally energized by electrical source 13 resulting in core 100 being pulled into body 98 by a force sufficient to overcome the force exerted by the actuator spring 94 on actuation member 86.

Timer Means/Override Means

Still referring to FIG. 3*a*, the time delay release mechanism 10 includes a timer means designated generally by the reference number 110 having an override means identified by the general reference number 112 defined by an override member designated generally by the reference number 114 comprising an elongate cylindrical override shaft 116 slidably mounted in flanges 118*a*, 118*b* secured to mounting surface 82. Override member 114 has a collar 120 disposed between flanges 118*a*, 118*b* and fixedly attached to override shaft 116 by a radial screw 122. Alternatively, collar 120 may be press-fitted to shaft 116 or integrally cast therewith as a single member. As described further hereinbelow, a collar post 124 fixedly attached to collar 120 extends perpendicularly away from mounting surface 82.

The override means 112 is further defined by an override drive means including a mechanical biasing means defined by an override spring 126 disposed about shaft 116 and compressed between flange 118*b* and collar 120. Since flange 118*b* is attached to mounting surface 82, override spring 126 urges collar 120 toward flange 118*a*, as more fully described hereinbelow. The collar 120 has a sufficient radial dimension such that upon sufficient translation of collar 120 toward flange 118*a*, collar 120 engages core 100 of brake actuation means 84.

The override drive means also includes override solenoids identified by the general reference numbers 128, 130, each including, respectively, a body 132, 134 secured to mounting surface 82 and an elongate core designated generally by the respective reference numbers 136, 138. The ends of the cores 136, 138 extending from the bodies 132, 134 are forked for defining inner and outer arms 140*a*, 140*b*, 142*a*, 142*b*, respectively. The bossed end 143 of override member 114 adjacent flange 118*b* is disposed between inner arms 140*a*, 142*a* and joined thereto by a pin 144 for linking the override member 114 to cores 136, 138. As illustrated in FIG. 3*a*, the outer arm 142*b* of core 138 has an outwardly projecting tab 146 attached thereto.

Figure 3B:
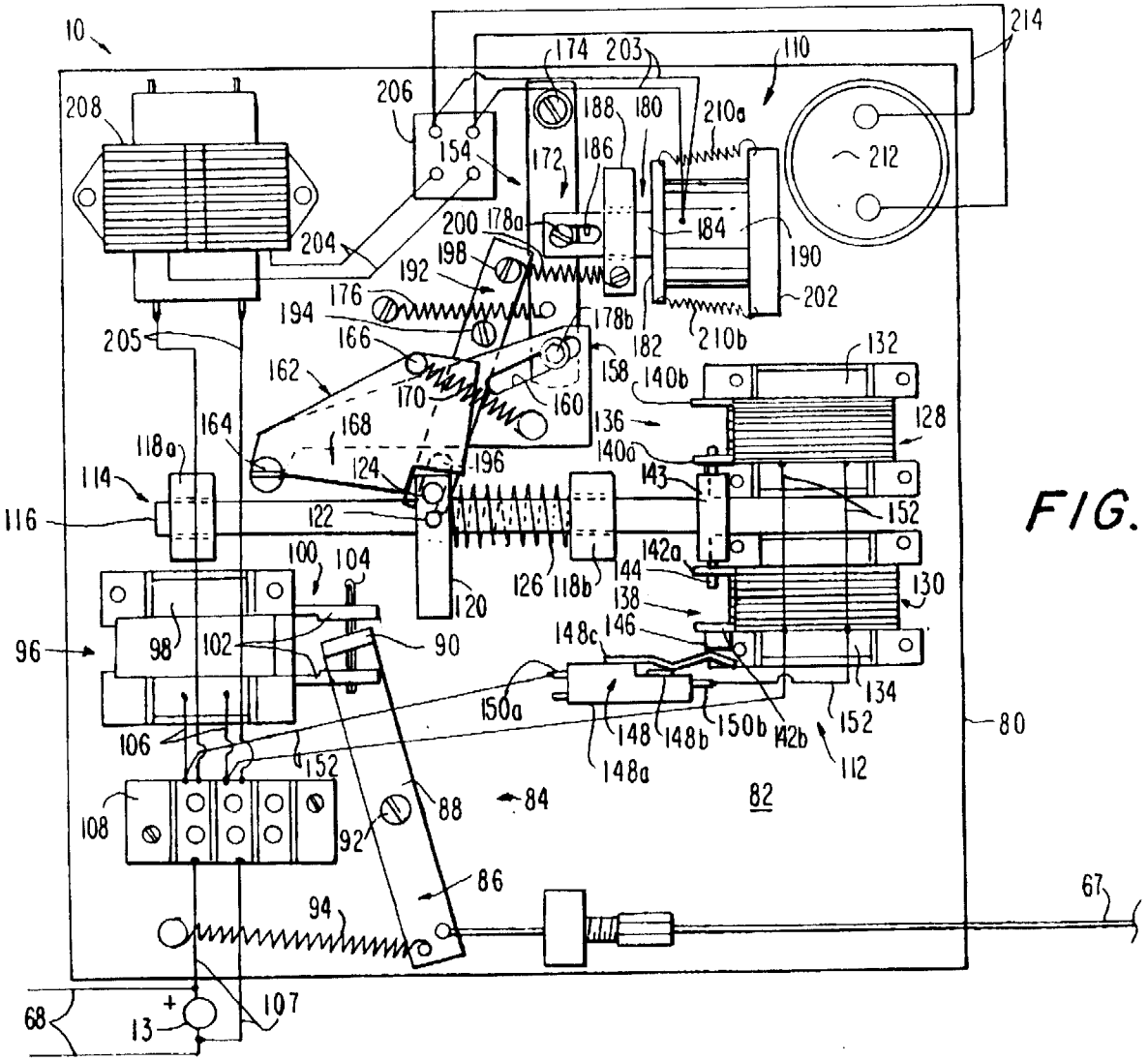
Figure 3C:
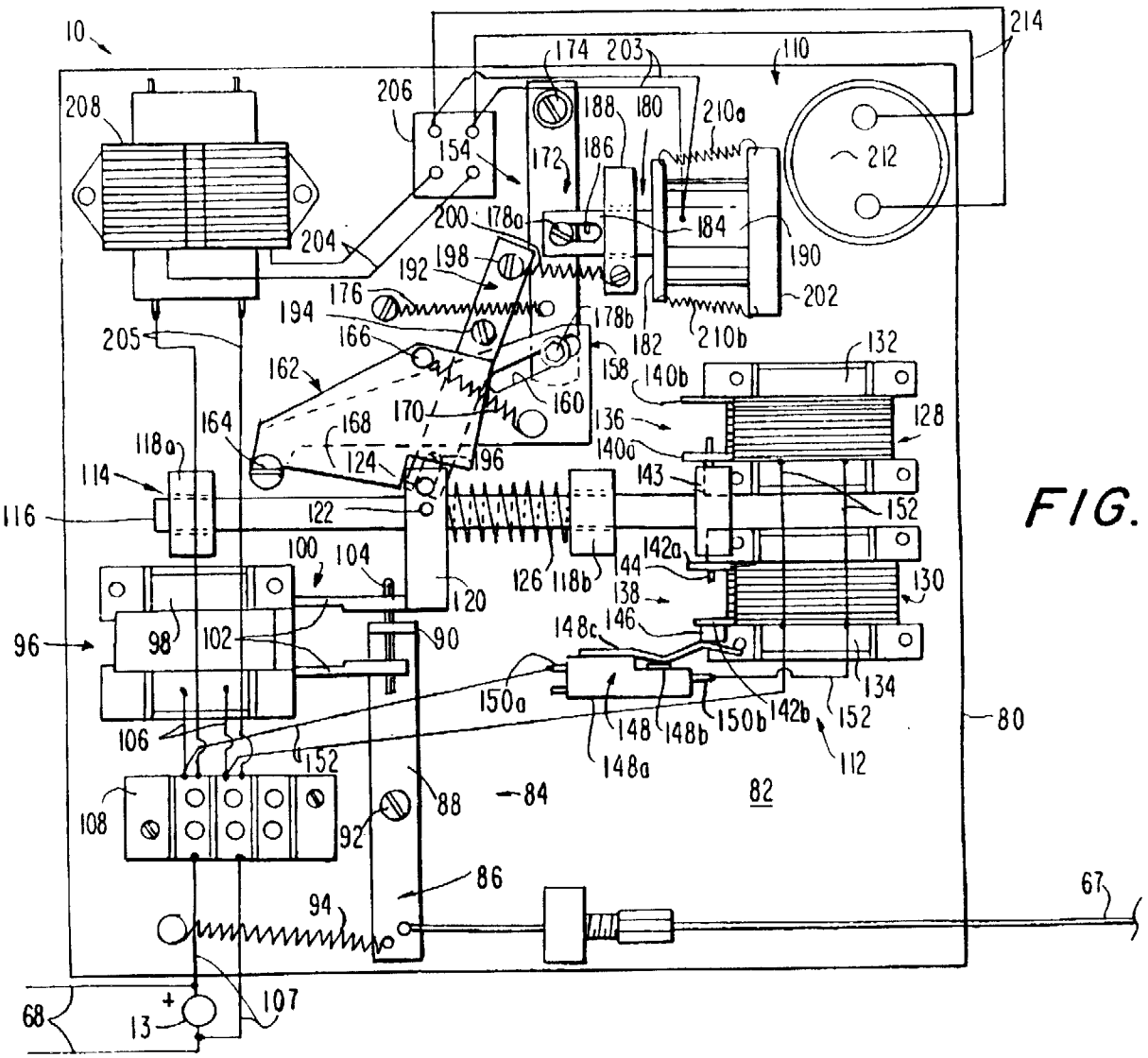
Figure 3D:
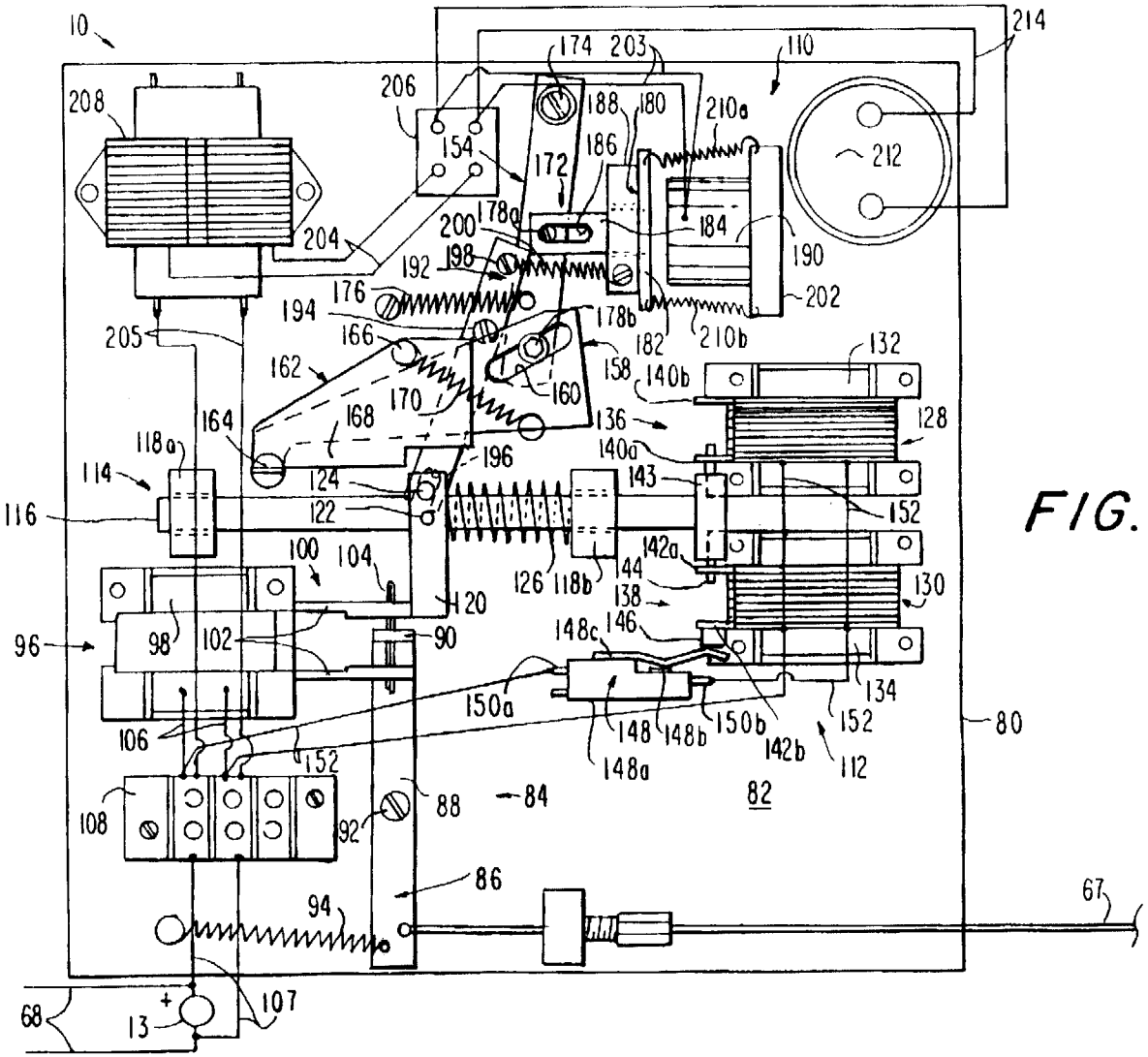

The override means 112 further includes a deenergizing switch identified generally by the reference number 148 having a housing 148*a* attached to mounting surface 82 adjacent to outer arm 12*b* of solenoid 130. Partially contained in housing 148*a* is a spring-loaded plunger 148*b* which yieldingly resists downward movement as viewed in FIG. 3*a*. The switch 148 also includes an interface member 148*c* cantilevered to housing 148*a* and disposed between plunger 148*b* and tab 146. The interface member 148*c* has an angled portion which is positioned relative to plunger 148*b* such that retraction of cores 136, 138 into respective bodies 132, 134 results in tab 146 engaging the angled portion of interface member 148*c*. When cores 136, 138 are fully retracted into respective bodies 132, 134, tab 146 deflects interface member 148*c* sufficiently to fully depress plunger 148*b* as shown in FIGS. 3*b*, 3*c* and 3*d*. Of course it will be recognized that the switch 148 may be located elsewhere in relation to the override means, such as, for example, along the path of shaft 116 for activation by collar 120, as long as depression of plunger 148*b* occurs when cores 136, 138 are retracted.

When plunger 148*b* is not depressed, as shown in FIG. 3*a*, a conductive path is established between switch terminals 150*a*, 150*b*. This conductive path, however, is opened when plunger 148*b* is depressed. As shown in FIG. 3*a*, the override solenoids 128, 130 are electrically connected, via conductors 107, 152, connector plate 108 and deenergizing switch 148, to electrical source 13. Like actuator solenoid 96, the override solenoids 128, 130 operate on 110 volt AC making transformers and the like between the override solenoids and electrical source 13 unnecessary.

When plunger 148*b* is not depressed as shown in FIG. 3*a*, i.e., tab 146 is disengaged from interface member 148*c*, override solenoids 128, 130 are energized. The cores 136, 138 are thereby pulled into respective bodies 132, 134, with sufficient force to overcome the force exerted by override spring 126 on collar 120 moving override shaft 116 to the right, as viewed in FIG. 3*a*. When tab 146 translates rightwardly sufficiently to fully depress plunger 148*b*, as shown in FIG. 3*b*, the conductive path between override solenoids 128, 130 and electrical source 13 is interrupted thereby deenergizing the override solenoids and releasing respective cores 136, 138 whereupon spring 126 urges collar 120 and attached shaft 116 to the left as viewed in FIG. 3*a*. Return of tab 146 to its leftmost position shown in FIG. 3*a* results in return of plunger 148*b* to its fully elevated position by the spring-loading thereof.

The pulling force required of override solenoids 128, 130 is larger than the pulling force required of actuator solenoid 96 because override spring 126 is considerably stiffer than actuator spring 94. Thus, when actuator solenoid 96 and override solenoids 128, 130 are deenergized and collar 120 is free to translate leftwardly, as viewed in FIG. 3*a*, actuation member 86 will be forced to the position shown in FIG. 3*a* and to be described further hereinbelow thereby overcoming the resistance of actuator spring 94. A preferred embodiment which satisfies these requirements, without using an actuator solenoid 96 having more pulling force than necessary (and requiring more electrical power than necessary), is one in which the required pulling forces are provided by a single actuator solenoid 96 and a pair of override solenoids 128, 130, all of which are substantially the same. Advantages of this approach are that a single electrical source 13 may supply the actuator and override solenoids 96, 128, 130 and assembly of the release mechanism 10 is simplified by having only one type of solenoid.

Those skilled in the art will recognize that other arrangements are possible which will satisfy the pulling force requirements for actuator member 86 and override member 114. For example, override solenoids 128, 130 may be replaced by a single solenoid having a larger pulling force than actuator solenoid 96. If such solenoids are supplied by the same electrical source (e.g., 13), it is likely that either the voltage to the override solenoid will have to be stepped up or the voltage to the actuator solenoid stepped down. Alternatively, actuator and override members 86, 114 may be coupled via one or more mechanical linkages to the respective solenoids or, possibly, to the same solenoid to adjust the pulling force of the solenoid(s) before application to the actuator and override members.

Timer Means/Trigger Means

The timer means 110 also includes a trigger means generally defined by the reference number 154 in FIG. 3*a*. Trigger means 154 includes a locating cam identified by the general reference number 158 having an elongate slot 160 and a latch means defined by a latch cam identified by the general reference number 162 having a shoulder portion 168. Locating cam 158 and latch cam 162 are joined by a pivot screw 164 to mounting surface 82 for rotation of cams 158, 162 about the pivot screw 164 in a plane parallel to the mounting surface. As depicted in FIG. 3a, latch cam 162 overlays locating cam 158 and shoulder portion 168 is generally adjacent to override member 114.

A post 166 attached to the surface of latch cam 162 extends toward the mounting surface in a perpendicular direction thereto. The post 166 extends nearer to mounting surface 82 than locating cam 158 such that upon sufficient clockwise rotation of latch cam 162 relative to locating cam 158, post 166 engages the edge of the locating cam thereby obstructing further rotation of latch cam 162.

Still referring to FIG. 3a, one end of a spring 170 is attached, via a screw connection, to the surface of locating cam 158 facing away from mounting surface 82. The other end of spring 170 is attached, via a screw (not shown), to the surface of latch cam 162 facing away from mounting surface 82 at a location generally above the post 166. The force of spring 170 biases the latch cam 162 for clockwise rotation relative to locating cam 158 with such rotation being limited by engagement of post 166 with the edge of locating cam 158 as described hereinabove.

The trigger means 154 further includes a first lever identified by the general reference number 172 attached by a pivot screw 174 to mounting surface 82 for rotation in a plane parallel to the mounting surface. The first lever 172 is closer to mounting surface 82 than locating cam 158 such that the locating cam overlays a portion of the first lever. One end of a spring 176 is hooked to a post or hole in lever 172 and the other end of the spring is anchored to the mounting surface 82 for urging clockwise rotation of the lever 172 as viewed in FIG. 3a.

Fixedly attached to first lever 172 are two posts 178a, 178b extending in a direction away from mounting surface 82 perpendicularly thereto, as shown in FIG. 3a. Post 178b extends through slot 160 in locating cam 158 such that clockwise rotation of first lever 172 translates post 178b in slot 160 for producing counterclockwise rotation of locating cam 158 and counterclockwise rotation of first lever 172 produces clockwise rotation of locating cam 158.

The trigger means 154 further includes a plunger means identified by the general reference number 180 having a magnetically responsive contact plate 182 and a stem 184 extending therefrom. Formed in the end of stem 184 opposite contact plate 182 is a slot 186.

The stem 184 is slidably mounted in a plunger flange 188 attached to mounting surface 82 for translation of stem 184 in a plane parallel thereto. The stem 184 is farther from mounting surface 82 than first lever 172 whereby the first lever is positioned between the free end of stem 184 and mounting surface 82.

The post 178a of first lever 172 extends through slot 186 such that, when first lever 172 rotates clockwise, post 178a engages one end of slot 186 for pulling plunger means 180 away from electromagnet 190 as described more fully hereinbelow.

The trigger means 154 also includes a second lever identified by the general reference number 192 attached by a pivot screw 194 to mounting surface 82 for rotation in a plane parallel thereto. Formed in one end of the second lever 192 is an open-ended slot 196. The second lever 192 is farther from mounting surface 82 than the end of collar post 124 such that the collar post is received in the slot 196. The slot 196 is wider than the collar post 124 for accommodating sliding movement of the collar post in the slot. The slot 196 is sufficiently long that the collar post 124 remains in the slot during travel of collar 120 between first and second flanges 118a, 118b.

The distance between second lever 192 and mounting surface 82 is such that the second lever is disposed between the locating cam 158 and the mounting surface, with a portion of the second lever 192 overlaying first lever 172.

A post 198 is fixedly secured to the surface of second lever 192 facing mounting surface 82 and extends toward the mounting surface in a direction perpendicular thereto. The post 198 extends to a point nearer to mounting surface 82 than first lever 172 such that upon sufficient clockwise rotation of second lever 192 and/or the first lever 172, post 198 engages the edge of the first lever.

A spring 200 is attached at one end, via a screw, to the surface of second lever 192 facing away from mounting surface 82 at a location generally above the post 198. The other end of spring 200 is attached via a screw to the surface of plunger flange 188 facing away from mounting surface 82. Spring 200 biases second lever 192 for clockwise rotation to ensure engagement between post 198 and first lever 172 when electromagnet 190 is demagnetized, as is described more fully hereinbelow.

The trigger means 154 is further defined by an electromagnet 190 secured to a base 202 attached to mounting surface 82. The electromagnet 190 is electrically connected to electrical source 13 via conductors 107, 203, 204, 205, connecting plate 108, transformer 208 and rectifier 206, as illustrated in FIG. 3a. The transformer 208 converts the 110 volt AC of electrical source 13 to 24 volt AC, and the rectifier 206 converts the 24 volt AC from the transformer to 24 volt direct current (DC) as required by electromagnet 190. The electromagnet 190 becomes magnetized when supplied with electricity.

The trigger means 154 further comprises a mechanical return means defined by springs 210a, 210b hooked at opposite ends to contact plate 182 and base 202.

When electromagnet 190 is magnetized, contact plate 182 is drawn into engagement therewith with a force sufficient to maintain such engagement against the maximum opposing force normally exerted by first lever 172, as described hereinbelow. The springs 210a, 210b while exerting less force on plunger means 180 than that exerted by magnetized electromagnet 190, nevertheless retain contact plate 182 adjacent to, if not against, the electromagnet against a nominal opposing force which may be exerted by first lever 172, again as more fully described hereinbelow. The forces exerted by springs 210a, 210b are balanced by their symmetrical positions about contact plate 182 and base 202 to minimize canting of the contact plate relative to magnet 190.

Timer Means/Capacitive Means

Still referring to FIG. 3a, timer means 110 includes a capacitive device defined by a capacitor 212 secured to mounting surface 82. The capacitor 212 is electrically connected in parallel to transformer 208 and electromagnet 190 via conductors 203, 204, 214, and rectifier 206. The capacitor 212 is charged by 24 volt DC from rectifier 206 which converts the 24 volt AC received from transformer 208.

When the 110 volt AC from electrical source 13 to transformer 208 is interrupted, charged capacitor 212 discharges 24 volt DC, via conductors 203, 214, to electromagnet 190 such that the electromagnet remains magnetized immediately after power interruption. If capacitor 212 completely discharges before power from transformer 208 to electromagnet 190 is restored, then electromagnet 190 is demagnetized.

Operation

The time delay release mechanism 10 must be "reset" to automatically respond to an interruption in power from electrical source 13. In the advantageous manner of the present invention described hereinbelow, the release mechanism 10 automatically "resets" itself when electrical source 13 supplies power thereto.

Resetting release mechanism 10 after power interruption exceeding discharge time of capacitor 212

Before power is supplied to the release mechanism 10 (i.e. after a power interruption of sufficiently long duration that capacitor 212 is discharged and actuator solenoid 96, override solenoids 128, 130 and electromagnet 190 are deenergized), actuation member 86 is in the released position thereof, shown in FIG. 3*a*, in which brake cable 67 is relaxed thereby allowing motor-operator unit 22, shown in FIG. 1, to control raising and lowering of fire door 16. Actuation member 86 is held in the released position by collar 120 of override member 114 acting on core 100. It will be appreciated that in this position the spring force of override spring 126 overcomes the opposing spring force of actuator spring 94 acting on the other end of actuation member 86. In this condition, solenoids 128, 130 are deenergized and offer no resistance to override spring 126. With electromagnet 190 deenergized, the springs 210*a*, 210*b* nevertheless maintain contact plate 182 sufficiently close to electromagnet 190 so that the contact plate will be magnetically influenced by the electromagnet 190 when energized, as will be explained more fully hereinbelow.

When power is restored by electrical source 13 to the time delay release mechanism 10, capacitor 212 is again charged and override solenoids 128, 130 are energized for retracting respective cores 136, 138 into bodies 132, 134 with sufficient force to overcome override spring 126, as shown in FIG. 3*b*. The actuation member 86 remains, however, in the released position shown in FIG. 3*b* because energized actuator solenoid 96 retains core 100 within body 98 with sufficient force to overcome the spring force of actuator spring 94. Based on the current requirements of solenoids 128, 130 upon power restoration, a solid state time delay unit (not shown) may be interposed between the power source 13 and solenoids 128, 130 to allow capacitor 212 to charge independently for several seconds before the solenoids 128, 130 are re-energized. This reduces any tendency of the solenoids 128, 130 to chatter if, upon initial charging, the capacitor 212 pulls down too much current.

Full retraction of cores 136, 138 into respective bodies 132, 134 moves override member 114 to the "cocked" position thereof in which tab 146 on outer arm 142*b* engages deenergizing switch 148. As explained hereinabove, engagement of tab 146 with deenergizing switch 148 causes deenergizing of the override solenoids 128, 130 thereby releasing cores 136, 138 from respective bodies 132, 134. However, the override spring 126 does not immediately return collar 120 to its override position shown in FIG. 3*a* because immediately before tab 146 engages switch 148, timer means 110 interposes an obstruction in the travel path of collar 120 preventing translation thereof to the override position, as described more fully hereinbelow.

Supply of power to the release mechanism 10 also energizes electromagnet 190 causing magnetization thereof. The contact plate 182, held close to the electromagnet 190 by springs 210*a*, 210*b*, is now pulled flush against the energized electromagnet to its latched position.

With contact plate 182 in the latched position and spring 176 urging clockwise rotation of first lever 172, post 178*a* on first lever 172 is lodged in the leftmost end of slot 186 as viewed in FIG. 3*a*, thereby establishing the set position of first lever 172. It will be appreciated that movement of post 178*b* in slot 160 as first lever 172 pivots about pivot screw 174 also results in locating cam 158 pivoting counterclockwise about its pivot screw 164 for establishing the set position of locating cam 158. The clockwise rotational force exerted by spring 170 on latch cam 162 is blocked by abutment of shoulder 168 on collar 120. As shown in FIG. 3*b*, when collar 120 clears the end of shoulder 168, which occurs before the collar reaches its fully cocked position in which switch 148 is deenergized, spring 170 rotates latch cam 162 clockwise such that shoulder 168 is now in the path of translation of collar 120.

As collar 120 reaches its fully cocked position, tab 146 engages switch 148, override solenoids 128, 130 are deenergized and override spring 126 urges collar 120 to its override position. However, shoulder 168, now positioned to the left of collar 120 (as viewed in FIG. 3*b*) in the path of translation thereof, blocks movement of the collar to its override position. In this position, the collar 120 is in its cocked position wherein the override spring 126 will urge collar 120 to the left in FIG. 3*b* as soon as the obstacle of shoulder 168 is removed.

It will be appreciated that movement of collar 120 to the cocked position also rotates the second lever 192 counterclockwise as collar post 124 translates in slot 196 thereby moving post 198 away from first lever 172. As counterclockwise rotation of second lever 192 is resisted by the spring force of spring 200, it will now be recognized that the retracting force of solenoids 128, 130 must be sufficiently strong to overcome springs 126 and 200.

Operation of release mechanism 10 during a temporary power outage.

When the supply of power by electrical source 13 is interrupted, which may be due to a fire, but which may also be due to a temporary outage unrelated to an emergency condition, actuator solenoid 96 is deenergized thereby releasing core 100 and freeing actuation member 86 for clockwise rotation under the influence of actuator spring 94 to the position shown in FIG. 3*c*. Clockwise rotation of actuation member 86 tensions brake cable 67 retracting core 60 into brake solenoid 58, as shown in FIG. 2*b*, thereby rotating brake control shaft 66 counterclockwise for engaging brake 44 and preventing closure of fire door 16.

Immediately after interruption of power to the release mechanism 10, capacitor 212 discharges power stored therein to electromagnet 190 such that electromagnet 190 is unaffected by the initial power interruption. As shown in FIG. 3*c*, first lever 172 accordingly remains in the set position thereby maintaining latch cam 162 in engagement with collar 120 and collar 120, in turn, in the cocked position.

If power from source 13 is restored to release mechanism 10 before complete discharge of capacitor 212, it will be apparent that electromagnet 190 will have remained magnetized throughout the power outage. After restoration, electrical source 13 once again supplies power to capacitor 212, thereby replacing the charge lost to electromagnetic 190 during the power interruption and restoring the capacitor to full charge. Collar 120 thereby remains in the cocked position throughout the power interruption.

Restoration of power to release mechanism 10 also energizes actuator solenoid 96 retracting core 100 into body 98 thereby rotating actuation member 86 counterclockwise with sufficient force to overcome actuator spring 94 and for returning the actuation member 86 to the position shown FIG. 3*b*. Counterclockwise rotation of actuation member 86 relaxes brake cable 67 for releasing core 60 of brake solenoid 58 thereby restoring control of brake 44 to brake controller 38.

It will be appreciated therefore that the release mechanism 10 prevents closure of fire door 16 by a power interruption shorter in duration than a predetermined time period defined by the time required for capacitor 212, when fully charged, to discharge the power stored therein. The discharge time for capacitor 212 may be in the range of approximately 10 seconds, although it will be understood that other discharge times may be more preferred and readily achieved such as by changing the quantity or size of capacitor 212. Additionally, and of equal importance, it will also be appreciated that following a power interruption of short duration, release mechanism 10 is automatically reset by restoration of power thereto from source 13.

Operation of release mechanism 10 if power interruption exceeds discharge time of capacitor 212

If power is not restored to release mechanism 10 before capacitor 212 completely discharges, when capacitor 212 is completely discharged electromagnet 190 is deenergized and, consequently, demagnetized. When electromagnet 190 is deenergized, it releases contact plate 182 which is then drawn away from the electromagnet by first lever 172 which, under the influence of spring 176, rotates clockwise to the position shown in FIG. 3*d*. During clockwise rotation of first lever 172, post 178*a*, acting on slot 186, is free to move plunger means 180 to the left in FIG. 3*d* as the contact plate 182 is no longer retained against electromagnet 190 by the magnetic force thereof. It will be recalled that movement of collar 120 to its cocked position (FIG. 3*b*) upon the initial interruption of power from source 13 has rotated second lever 192 counterclockwise thereby moving post 198 away from first lever 172 and removing the obstruction to clockwise rotation of first lever 172 established by post 198 when collar 120 is in its override position (FIG. 3*a*).

Clockwise rotation of first lever 172 causes post 178*b* thereon to translate in slot 160 producing counterclockwise rotation of locating cam 158. Counterclockwise rotation of locating cam 158 results in the upper edge thereof (as viewed in FIG. 3*d*) engaging post 166 on latch cam 162 which produces concomitant counterclockwise rotation of the latch cam which causes shoulder 168 thereof to move out from the movement path of collar 120. With the obstruction provided by shoulder portion 168 removed, collar 120 moves under the urging of override spring 126 to the override position in which the collar forces core 100 into body 98 thereby moving actuation member 86 to the released position with sufficient force to overcome actuator spring 94.

Movement of actuation member 86 to the released position relaxes brake cable 67 thereby releasing core 60 of brake solenoid 58. Assuming brake shoes 46 are not otherwise forced to pivot outwardly into engagement with drum 42, which is normally the case, release of core 60 results in springs 48 forcing brake shoes 46 to pivot inwardly releasing brake 44 and rotating brake control shaft 66 clockwise to the position depicted in FIG. 2*a* and described more fully hereinabove. Assuming further that output shaft 14 is not otherwise prevented from rotating, which is also normally the case, the release of brake 44 results in fire door 16 unwinding from the output shaft 14 and falling downward under the force of gravity thereby to close. Accordingly, if power from electrical source 13 to release mechanism 10 is not restored before capacitor 212 fully discharges (i.e., within the predetermined time period set by the discharge time of capacitor 212), then the release mechanism allows closure of fire door 16.

Those skilled in the art will appreciate that the capacitive power storage device exemplified by capacitor 212 may be replaced by other power storage devices or auxiliary power sources, such, for example, as a battery, so long as the device supplies power to the electromagnet 190 immediately after an interruption of power thereto from transformer 208 and the auxiliary source continues such power supply for a duration no greater than a predetermined time period.

Movement of collar 120 to the override position also produces, via the cooperation between collar post 124 and slot 196, clockwise rotation of second lever 192 sufficient to move post 198 rightwardly to the position shown in FIG. 3*a*. Spring 176, which urges first lever 172 to rotate clockwise, causes the edge of first lever 172 to engage post 198 such that first lever 172 is held in its set position. Due to the cooperation between post 178*b* and slot 160, so positioning first lever 172 in turn locates locating cam 158 in the set position. Thus, locating cam 158 is automatically reset when collar 120 moves to the override position.

Resetting of release mechanism 10 is automatically completed by restoration of power from electrical source 13, as described hereinabove under the heading "Resetting release mechanism 10 after power interruption exceeding discharge time of capacitor 212".

Alternative Embodiment

Figure 4:
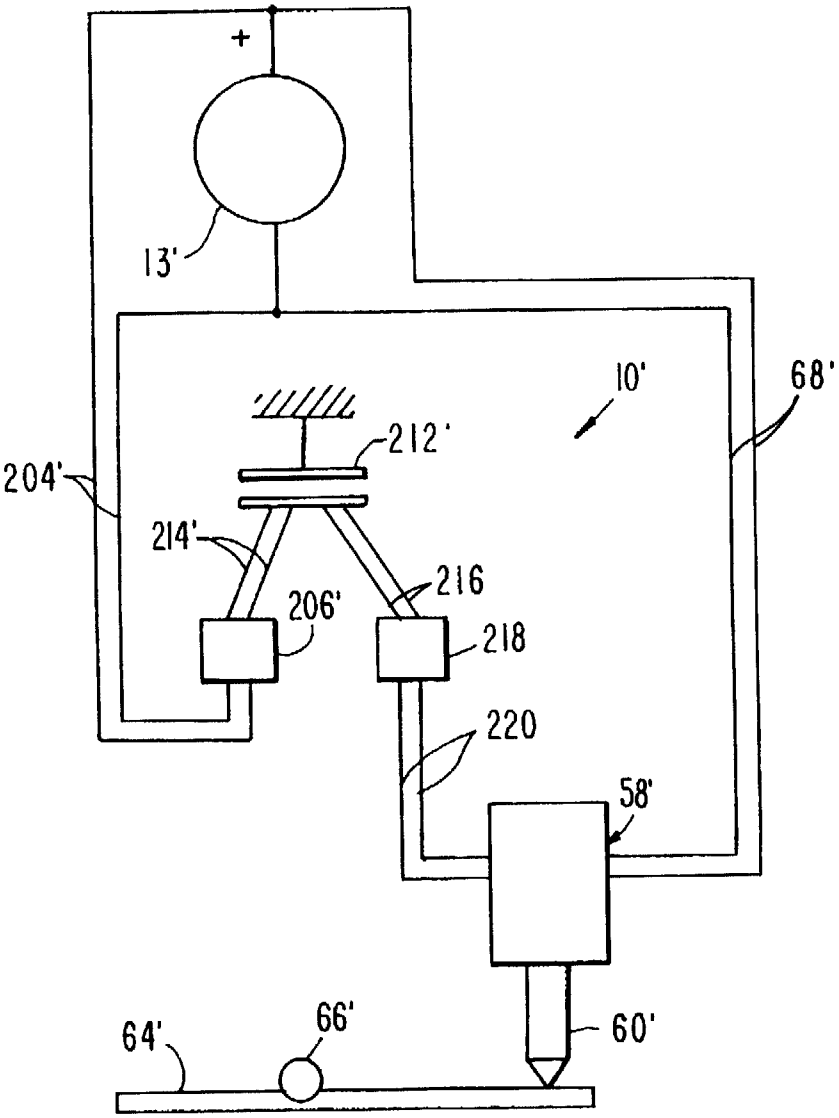
FIG. 4 is a schematic diagram of an alternative embodiment of the time delay release mechanism of the present invention.

An alternative embodiment of the time delay release mechanism 10' of the present invention is illustrated schematically in FIG. 4. FIG. 4 elements similar to those depicted in FIGS. 1, 2*a–b*, and 3*a–d* have like reference numerals with the addition (in FIG. 4) of the "prime" delineator. The release mechanism 10' may be used with the motor controlled fire door assembly 12 illustrated in FIGS. 1, 2*a* and 2*b* as well as any other fire barriers, such as those suggested for use with release mechanism 10 of FIGS. 1, 2*a*, 2*b* and 3*a–d*.

Release mechanism 10' is defined by a capacitor 212' electrically connected, via conductors 214', to a rectifier 206' which is electrically connected, via conductors 204', to electrical source 13'. Capacitor 212' is also electrically connected, via conductors 216, to a inverter 218 which is electrically connected, via conductors 220, to brake solenoid 58'. The electrical source 13' is also electrically connected directly, via conductors 68', to brake solenoid 58'.

During normal operation, electrical source 13' supplies AC, via conductors 68', directly to brake solenoid 58' enabling the brake solenoid to selectively engage the brake (not shown) to selectively prevent closure of the fire door. The electrical source 13' also supplies AC, via conductors 204', to rectifier 206' which supplies DC, via conductors 214', to the capacitor 212' for charging the latter.

When power from electrical source 13' to brake solenoid 58' via conductors 68' is interrupted, capacitor 212' discharges to inverter 218 which converts DC from capacitor 212' to AC required by brake solenoid 58'. Conductors 220 supply AC from inverter 218 to the brake solenoid 58'. Brake solenoid 58' thereby becomes energized thereby retracting core 60' into the solenoid body which actuates brake 44' to prevent closure of the fire door (not shown).

The brake solenoid 58' retains core 60' in the retracted position until the earlier of complete discharge of capacitor 212' or restoration of power to the brake solenoid 58' from electrical source 13'. After complete discharge of capacitor 212' without restoration of source 13, brake solenoid 58' deenergizes releasing core 60' and allowing closure of the fire door (not shown). The result is, of course, that closing of fire door (not shown) has been delayed a predetermined time period from commencement of the power interruption, with the predetermined time period determined by the discharge time of capacitor 212'.

Upon restoration of power from electrical source 13' to brake solenoid 58' via conductors 68', brake solenoid 58' is able to engage the brake (not shown) by rotating brake control shaft 66' in a similar manner as described hereinabove in connection with brake solenoid 58 and brake control shaft 66. The connection between electrical source 13' and capacitor 212' via conductors 204', depicted in FIG. 4, provides for recharging of capacitor 212' upon restoration of power from electrical source 13'.

When capacitor 212' is fully charged, release mechanism 10' prevents closure of the fire door (not shown) when the power is interrupted for a shorter duration than a predetermined time period defined by the time required for capacitor 212', when fully charged, to completely discharge the power stored therein. Thus, release mechanism 10' is reset automatically by restoration of power thereto from electrical source 13'. The release mechanism 10' also provides the same time delay between a power interruption and closure of the fire door (not shown) as release mechanism 10.

However, capacitor 212' requires considerably more electrical storage capacity as compared to capacitor 212 since capacitor 212' supplies current to brake solenoid 58' while capacitor 212 supplies electromagnet 190. This results from brake solenoid 58' having to exert a substantially larger pulling force on lever 64' to engage the brake (not shown) compared to the force required of electromagnet 190 to retain contact plate 182 in abutment therewith. Consequently, capacitor 212' will usually be more expensive and bulkier than capacitor 212 since the size and cost of a capacitor is typically proportional to the electrical storage capacity thereof. Similarly, inverter 218 may be more expensive and bulky than rectifier 214 since inverter 218 is required to handle the larger current supplied from capacitor 212' to brake solenoid 60'.

Additionally, a relay (not shown) may be placed electrically in parallel to the capacitor 212 to activate a bell, light or other warning means during the discharge of capacitor 212, to alert persons proximate the door during a power interruption of the fire door's imminent closure.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all elements and/or method steps which perform substantially the same function in substantially the same way to achieve substantially the same result as the elements specifically disclosed in the specification and recited in the claims are within the scope of the invention. It is the intention, therefore, to be limited only as indicated by the scope of the claims appended hereto.

What is claimed is:

1. A time delay release mechanism controlled by an electrical power source and connected to a fire barrier biased to close when power to said time delay release mechanism is interrupted, said time delay release mechanism comprising:

an actuation member movable between an engaged position and a released position, said actuation member being operatively engageable with the fire barrier such that when said actuation member is in said engaged position said actuation member prevents closure of the fire barrier and when said actuation member is in said released position, said actuation member allows closure of the fire barrier;

driver means electrically connected to the electrical power source for moving said actuation member to said released position when power is supplied and for moving said actuation member to said engaged position when power is interrupted; and a timer electrically connected to the electrical power source and mechanically connected to said actuation member such that when said timer receives power or when power to said timer is interrupted for a duration less than a predetermined time period, said timer disengages from said actuation member, said timer engaging said actuation member when power to said timer is interrupted for a duration greater than said predetermined time period so as to move said actuation member to said released position thereby overriding said actuation driver means to allow closure of the fire barrier, said timer disengaging from said actuation member and said actuation driver means retaining said actuation member in said released position when power is restored, thereby automatically resetting said brake actuation means and timer.

2. A time delay release mechanism in accordance with claim 1, wherein said brake actuation means further comprises a cable secured at one end to said actuation member and at another end to the fire barrier such that, when said actuation member is in said engaged position, said cable is tensioned preventing closure of the fire barrier and, when said actuation member is in said released position, said cable is relaxed allowing closure of the fire barrier.

3. A time delay release mechanism in accordance with claim 1, wherein said actuation driver means includes an actuator solenoid coupled to said actuation member and electrically connected to the electrical power source such that when power is supplied said actuator solenoid moves said actuation member to said released position, said actuation driver means further including an actuator spring which urges said actuation member to said engaged position when power to said actuator solenoid is interrupted.

4. A time delay release mechanism in accordance with claim 1, wherein said timer further comprises override means comprising an override member movable between a cocked position and an override position, such that in said cocked position said override member is disengaged from said actuation member and in said override position said override member forcibly engages said actuation member for moving said actuation member to said released position, said override means further comprising override drive means electrically connected to the electrical power source for moving said override member to said cocked position when power is supplied and for moving said override member to said override position when power is interrupted, said timer further comprising a trigger electrically connected to the electrical power source, such that when said override member is in said cocked position and power is supplied said trigger engages said override member to prevent movement thereof to said override position, said trigger remaining in said engagement with said override member when power is interrupted for a duration less than said predetermined time period and disengaging from said override member when power is interrupted for a duration greater than said predetermined time period so as to allow said override drive means to move said override member to said override position, thereby moving said actuation member to said released position.

5. A time delay release mechanism in accordance with claim 4, wherein said override drive means comprises an override solenoid mechanically coupled to said override member and electrically connected to the electrical power source, such that when power is supplied said override solenoid moves said override member to said cocked position, said override drive means further including mechanical biasing means for moving said override member to said override position when power to said override solenoid is interrupted for a duration greater than said predetermined time period.

6. A time delay release mechanism in accordance with claim 4, wherein said timer further comprises capacitive means for chargeably storing power when electrically connected in parallel to the electrical power source and said trigger, such that when said trigger is in said engagement with said override member and power to said trigger is interrupted, said capacitive means discharges power stored therein to said trigger causing said trigger to maintain said engagement with said override member for a duration no greater than said predetermined time period, said engagement between said trigger and said override member being uninterrupted if power is restored within said predetermined time period, said trigger disengaging from said override member if power is interrupted for a duration greater than said predetermined time period.

7. A time delay release mechanism in accordance with claim 4, wherein:

said trigger comprises an electromagnet electrically connected to the electrical power source, said electromagnet being magnetized when supplied with power and unmagnetized when power is interrupted, said trigger further comprising a latch linked to an electrically conductive plunger movable between a latched position and an unlatched position, such that when said plunger is in said latched position and said override member is in said cocked position said latch engages said override member to prevent movement thereof to said override position, said magnetized electromagnet magnetically influencing said plunger means to move to said latched position and remain therein, said unmagnetized electromagnet allowing said plunger to move to said unlatched position wherein said latch is disengaged from said override member thereby allowing said override member to move to said override position, said timer further comprising an auxiliary power source electrically connected to said electromagnet such that when power to said electromagnet from the electrical power source is initially interrupted said electromagnet receives a continuous supply of auxiliary power for a duration no greater than said predetermined time period, thereby delaying movement of said plunger to said unlatched position, said plunger remaining in said latched position such that said latch engages said override member, thereby retaining said override member in said cocked position if power from the electrical power source to said electromagnet is restored within said predetermined time period, said plunger moving to said unlatched position such that said latch disengages from said override member if power from the electrical power source to said electromagnet is interrupted for a duration greater than said predetermined time period.

8. A time delay release mechanism in accordance with claim 7, wherein said trigger further comprises mechanical return means operatively engaged with said plunger for moving said plunger, such that when said plunger is in said unlatched position said return means moves said plunger sufficiently close to said electromagnet so that upon magnetization of said electromagnet said plunger will be magnetically influenced to move to said latched position, said plunger thereby being automatically resettable by said return means.

9. A time delay release mechanism controlled by an electrical power source and connected to a fire barrier biased to close when power to said time delay release mechanism is interrupted, said time delay release mechanism comprising:

brake actuation means electrically connected to the electrical power source and selectively engageable with the fire barrier, said brake actuation means being operatively disengaged from the fire barrier for allowing closure of the fire barrier when power is supplied to the brake actuation means; and a timer comprising an override means operatively engageable with said brake actuation means for operatively disengaging said brake actuation means from the fire barrier, said timer further including a trigger means operatively engageable with said override means for preventing said operative engagement between said override means and said brake actuation means, said trigger means being electrically connected to the electrical source such that when power is supplied said, trigger means operatively engages said override means for preventing said operative engagement between said override means and said brake actuation means, and when power is interrupted, said trigger means operatively disengages said override means so that said override means operatively engages said brake actuation means, said timer further comprising a capacitive storage device electrically connected in parallel to the electrical power source and said trigger means and being charged when power is supplied thereto, such that when power is interrupted said capacitive device discharges power stored therein to said trigger means causing said trigger means to maintain said operative engagement with said override means for a duration no greater than said predetermined time period, thereby allowing said brake actuation means, when power thereto is initially interrupted, to operatively engage the fire barrier for preventing closure thereof, said operative engagement between said trigger means and said override means being uninterrupted if power is restored within said predetermined time period, said trigger means disengaging from said override means if power from the electrical source to said trigger means is interrupted for a duration greater than said predetermined time period, so that closure of the fire barrier is delayed from the commencement of the power interruption for a time period determined by the time duration of discharge of said capacitive device, restoration of power operatively disengaging said brake actuation means from the fire barrier and recharging said capacitive device thereby automatically resetting said brake actuation means and timer.

* * * * *